United States Patent [19]

Power

[11] 4,413,429

[45] Nov. 8, 1983

[54] MOLDED FOOT BED

[75] Inventor: Roy J. Power, Berwyn, Pa.

[73] Assignee: Power-Soler, Inc., Wetumpka, Ala.

[21] Appl. No.: 275,662

[22] Filed: Jun. 22, 1981

[51] Int. Cl.[3] ..... A43B 13/38

[52] U.S. Cl. ..... 36/44; 36/30 R

[58] Field of Search ..... 36/102, 30 R, 44, 43, 36/31

[56] References Cited

U.S. PATENT DOCUMENTS

| | | | |
|---|---|---|---|
| 774,622 | 11/1904 | Vogel | 36/44 |
| 1,807,341 | 5/1931 | Messler | 36/44 |
| 3,481,820 | 12/1969 | Jonas | 36/43 |
| 4,167,824 | 9/1979 | Wolpa | 36/44 |

*Primary Examiner*—Werner H. Schroeder

*Assistant Examiner*—Steven N. Meyers

*Attorney, Agent, or Firm*—Roland H. Shubert

[57] ABSTRACT

A foot bed insertable into a shoe and heat moldable to conform to the user's foot is provided. The foot bed comprises a three layer laminate in which the base, or bottom, layer comprises a relatively thick, heat deformable foam rubber material which maintains a compression set upon cooling. The middle layer is of foamed elastomer which is highly resistant to permanent deformation both of ambient temperature and at the moderately elevated temperatures used in molding the base layer. A top, or face, layer which is thinner and less compressible than the middle layer acts to uniformly distribute compression loads to the middle layer and to transmit lateral movements for absorption within the middle layer.

8 Claims, 3 Drawing Figures

MOLDED FOOT BED

BACKGROUND OF THE INVENTION

This invention relates to a moldable foot bed for insertion into a pair of shoes. More specifically, this invention relates to a laminated structure incorporating an inner sole and a foamed elastomer layer which is heat deformable to produce a conforming interface between a shoe last and the sole of the user's foot.

Shoes are manufactured to conform with a standard last while human feet display a much greater variety of form. Consequently, only a relatively small percentage of the populace can obtain a good and comfortable fit in standard shoes.

This problem has been long recognized and two standard approaches have evolved to alleviate it. One approach has been the provision of inner soles for fitting within a shoe to provide additional cushioning between the shoe last and the foot. The second approach has been to provide a molded insert patterned from the user's foot and inserted within the shoe.

Inner soles are typically constructed of an elastomeric foam material base often having a top, or foot contacting, cover of stretch nylon fabric or the like as is disclosed for example in U.S. Pat. No. 3,448,533. The stretch fabric is adhesively bonded to the base ply and provides a slick surface between the inner sole and the foot of the user. Another type of inner sole, also having a top cover of stretch fabric, is disclosed in the Wolpa patent, U.S. Pat. No. 4,167,834. The Wolpa inner sole consists of an open cell foam base which tends to compress and take a set under constant or sustained pressure. An elastic closed cell foam layer, thinner than the base, is provided intermediate the base and fabric covering.

The second approach, that of providing a molded insert patterned from the user's foot, is illustrated by U.S. Pat. No. 3,825,017. An inner sole is formed by first obtaining a negative impression of the foot of the user. The impression is then filled with plaster or the like to obtain a positive impression or casting. An inner sole composite material is then heat formed with pressure to provide a molded composite conforming to the user's foot. The composite is then trimmed for insertion into a shoe.

Another molded shoe insert is sold under the name "Conform'able" and is especially designed for use with ski boots. These inner sole inserts consist of a thermoplastic plate about one-eighth inch thick covered with a material routinely used for boot lining. They are semi-rigid after molding and are molded by causing the user to stand in a skier's stance on heated inner sole blanks while bracing against a frame to increase the pressure on the inner sole blanks.

While the prior art inner soles and molded inserts do alleviate a number of problems of discomfort, blistering and the like associated with the imperfect fit between an individual foot and a standard shoe, all fall short of providing maximum adaptability and foot protection. Specifically, a relatively slick surfaced inner sole such as those utilizing a stretch nylon top cover allows relative movement of the foot across the inner sole, a condition which can cause frictional blistering, rather than absorbing lateral movement within the inner sole structure. Shoe inserts molded to a user's foot in turn seldom conform to the last of the shoe itself and thus introduce new problems.

SUMMARY OF THE INVENTION

This invention provides a molded foot bed for insertion and wearing in shoes. The foot bed is constructed of a three-layer laminate of foamed rubbers, each layer of the laminate having specific thermal and elastomeric properties. The bottom, or shoe contacting layer is thickest and comprises a foam material which deforms at temperatures on the order of 150° F. to take a permanent compressive set upon cooling. The intermediate layer is of high resilience and elasticity and, in addition, does not take a permanent compressive set at those temperatures, ranging from about 130° to about 170° F., used in molding the bottom layer. A top, or face, layer is thinnest of the three, is less resilient and less elastic than the intermediate layer, and is resistant to substantial compressive set at molding temperatures. The foot bed is molded to achieve a conforming interface between the user's foot and a shoe last by heating a pair of laminated blanks sized to the shoes to a temperature typically on the order of 150° F. and inserting the blanks within the shoes. The user then dons the shoes and stands or walks in them until the laminate cools. Upon cooling, the base layer of the laminate takes a permanent compressive set to the shoe last and to the user's foot.

Hence, it is an object of this invention to provide a foot bed constituting a conforming interface between a shoe last and the foot of a user.

Another object of this invention is to mold a foot bed in place within a shoe to attain maximum conformation between the shoe and a user's foot.

DETAILED DESCRIPTION OF THE INVENTION

Figure 1:
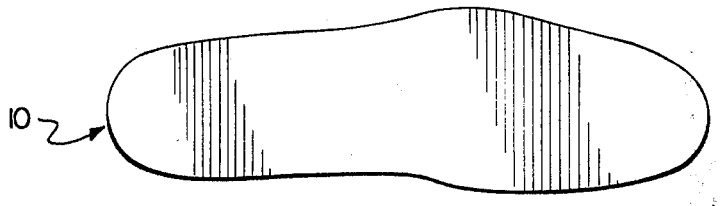
FIG. 1 is a plan view of a foot bed blank showing its general shape and configuration.

Referring now to the drawing, the foot bed 10 of this invention comprises a laminate cut to conform generally to a foot or shoe shape and trimmed to conform to the dimensions of the shoe within which it is placed.

Figure 2:
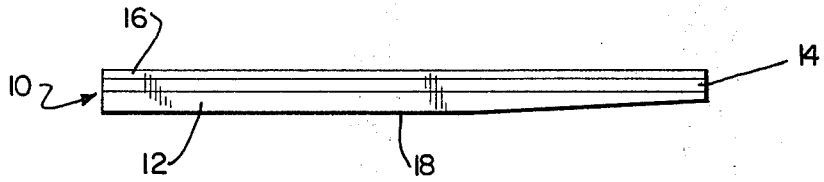
FIG. 2 is a side view of the blank of FIG. 1.
Figure 3:
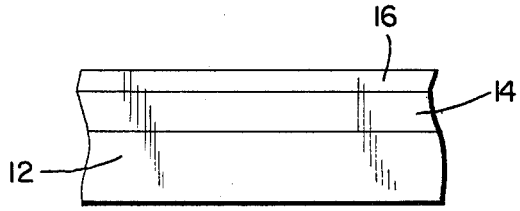
FIG. 3 is a partial sectional view of the foot bed blank illustrating the relative thicknesses of the laminate layers.

As is best shown in FIGS. 2 and 3, the foot bed consists of a three-layer laminate. The bottom, or base, layer 12 is the thickest of the three layers and comprises a foam rubber which is heat deformable at relatively low temperatures; from about 130° F. to about 170° F. It must have a relatively low density, preferably in the range of about 10 to about 25 pounds per cubic foot, and must take a permanent compression set of at least about 50% under the standing weight of an adult human upon cooling from heat deforming temperature. Thickness of base layer 12 may range generally between 3/16 and $\frac{3}{8}$ inches.

The precise composition of the base layer 12 is not critical so long as it meets the physical and performance criteria set out above. A number of different polymers may be compounded and foamed in a manner to meet the necessary criteria but certain styrene-butadiene rubbers are preferred. One such preferred rubber is that designated as Stock Number R-8407-S and supplied by the Rubatex Corporation of Bedford, Va. This is a foamed, closed cell, styrene-butadiene rubber having a density in the range of 10–20 pounds per cubic foot. It displays a compression deflection of 9–17 psi, a maximum water absorption of 50% by weight and will flex without cracking over a temperature range of −70° to 150° F. Compression set ranges from 25% to 35% as determined by ASTM D-1056 in which a one-half inch thick sample is compressed 50% for 22 hours at 70° F. and allowed to recover for 24 hours.

The intermediate layer 14 comprises a highly resilient and elastic foamed rubber having a high degree of resistance to permanent deformation or setting under load both at ambient and at moderately elevated temperatures. It must not take any significant degree of set under those temperatures and pressures (130° to 170° F. under the weight of an adult) at which the base layer takes a permanent compression set of 50% or more. Compositions appropriate for use as the intermediate layer include foamed neoprene rubbers. Such rubbers should display a compression deflection of about 5 to to 9 psi, a resilience as determined by the Bayshore Rebound method of approximately 50 to 65% and a minimum elongation of 200%. The intermediate layer must be thinner than is the base layer and preferably is approximately one-eighth inch in thickness.

Top or face layer 16 is substantially thinner than is the intermediate layer 14 and is preferably about one-half the thickness of the intermediate layer, or about one-sixteenth inch in thickness. It, like the base layer, may comprise a foamed styrene-butadiene copolymer rubber. But, unlike the base layer, top layer 16 must be much more resistant to taking a permanent compression set upon being subjected to moderate heat and pressure. It must display a permanent compression set of not more than about 20% at temperatures ranging from about 130° to 170° F. under the standing weight of an adult. In general, those foamed rubbers suitable for use as the top layer display a resilience as measured by the Bayshore Rebound method of between 20 and 30% and an elongation of at least 100%.

In a preferred embodiment of this invention, the top layer 16 and the intermediate layer 14 comprise the inner sole disclosed and claimed in my U.S. Pat. No. 4,285,144.

It is preferred that the thickness of base layer 12 uniformly taper from a point 18 (FIG. 2) at approximately the ball of the foot to the toe with a thickness at the toe of approximately half that of the full thickness of the base layer. This taper can be formed by grinding the base layer after the foot bed has been laminated and shaped to the shoe. Total thickness of the foot bed should not exceed about one-half inch so as to allow fitting into standard shoes without modification. In a most preferred embodiment, thicknesses of base layer 12, intermediate layer 14 and top layer 16 are in the approximate ratio of 4:2:1.

Installation of the foot bed within a pair of shoes is carried out in the following manner. First, the foot bed inserts are trimmed to conform closely to the shoe size. The inserts are then removed and are heated to a temperature in the range of about 130° to about 170° F., preferably to about 150° F. in a temperature controlled convection oven or the like. The foot bed inserts are then placed within the shoe and the user dons the shoes and stands and walks in them until cooling occurs and a permanent compression set of the base layer has been obtained. This procedure takes but a short time, normally about 5 to 10 minutes. During this time, the base layer 12 is permanently deformed and shaped to attain a conforming interface between the shoe and the user's foot. Many minor abnormalities in foot shape and structure are automatically corrected during the molding process without the need for supplemental orthodic inserts or devices.

The three laminate layers of the foot bed perform very separate and distinct functions. As set out previously, the base layer functions to provide a conforming interface between shoe and foot but, in its deformed and compression set state, provides little cushioning. Cushioning of the foot is provided primarily by the intermediate layer 14 which acts as well to absorb lateral movements of the foot relative to the shoe. Provision of the upper, less compressible top layer 16 acts to distribute loads imposed by the foot substantially evenly and uniformly across the intermediate layer and prevents that layer from bottoming out or reaching an uncompressible state. Additionally, the surface of the upper layer resists sliding or frictional movement of the foot relative to the foot bed surface but transmits these lateral movements for absorption within the intermediate layer.

I claim:

1. A moldable foot bed for insertion and wearing in a shoe comprising a laminate having three layers; a bottom or base layer comprising a foam rubber having a density ranging from about 10 to about 25 pounds per cubic foot and being heat deformable at a molding temperature ranging from about 130° to about 170° F. to take a permanent compression set of at least about 50% under the weight of an adult human, the thickness of said base layer ranging generally between 3/16 inches and 3/8 inches; an intermediate layer of a foam rubber which is highly resistant to permanent deformation under pressure at temperatures below about 170° F., said intermediate layer displaying a resiliency as determined by the Bayshore Rebound method of at least about 50%, having a minimum elongation of about 200%, and having a thickness approximately half that of said base layer, and a top or face layer thinner then said intermediate layer and having a resilience and elasticity substantially less than said intermediate layer; said face layer displaying a maximum compression set of less than about 20% at said molding temperature.

2. The foot bed of claim 1 wherein the total thickness is approximately one-half inch and wherein the thicknesses of said base layer, said intermediate layer and said face layer are in the approximate ratio of 4:2:1.

3. The foot bed of claim 1 wherein said base layer tapers in thickness from a point at approximately the ball of the foot forward to the toe.

4. The foot bed of claims 3 wherein said taper is uniform and wherein the thickness of the base layer at the toe is approximately half that of the untapered portion of said base layer.

5. The foot bed of claim 1 wherein said base layer is a foamed styrene-butadiene rubber.

6. The foot bed of claim 1 wherein said intermediate layer is a foamed neoprene rubber.

7. The foot bed of claim 1 wherein said face layer is a foamed styrene-butadiene rubber.

8. The foot bed of claim 1 wherein said base layer is compressed and permanently set to obtain a conforming interface between the shoe and a user's foot by heating the foot bed to approximately 150° F., inserting it into said shoe and placing said shoe upon the user's foot and thereafter applying the standing weight of the user to said foot bed until said foot bed cools to ambient temperature.

* * * * *